US011411314B2

(12) United States Patent
Takayama et al.

(10) Patent No.: US 11,411,314 B2
(45) Date of Patent: Aug. 9, 2022

(54) ANTENNA MODULE AND COMMUNICATION APPARATUS EQUIPPED THEREWITH

(71) Applicant: Murata Manufacturing Co., Ltd., Kyoto (JP)

(72) Inventors: Keisei Takayama, Kyoto (JP); Yoshiki Yamada, Kyoto (JP); Kengo Onaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 21 days.

(21) Appl. No.: 17/030,801

(22) Filed: Sep. 24, 2020

(65) Prior Publication Data

US 2021/0013608 A1 Jan. 14, 2021

Related U.S. Application Data

(63) Continuation of application No. PCT/JP2019/012650, filed on Mar. 26, 2019.

(30) Foreign Application Priority Data

Mar. 30, 2018 (JP) ..... JP2018-070044

(51) Int. Cl.

| | |
|---|---|
| ***H01Q 21/00*** | (2006.01) |
| ***H01Q 5/50*** | (2015.01) |
| ***H01Q 5/335*** | (2015.01) |
| ***H01Q 21/10*** | (2006.01) |
| ***H01Q 21/06*** | (2006.01) |

(52) U.S. Cl.

CPC ..... *H01Q 5/335* (2015.01); *H01Q 5/50* (2015.01); *H01Q 21/065* (2013.01); *H01Q 21/10* (2013.01)

(58) Field of Classification Search

CPC ..... H01Q 5/335; H01Q 5/50; H01Q 21/10; H01Q 9/0435; H01Q 9/045; H01Q 21/065

See application file for complete search history.

(56) References Cited

U.S. PATENT DOCUMENTS

| | | | | |
|---|---|---|---|---|
| 10,998,630 | B2 * | 5/2021 | Sudo | H04B 1/0458 |
| 11,024,955 | B2 * | 6/2021 | Onaka | H01P 3/08 |
| 11,108,145 | B2 * | 8/2021 | Sudo | H01Q 3/26 |
| 11,171,421 | B2 * | 11/2021 | Yamada | H01Q 21/065 |

(Continued)

FOREIGN PATENT DOCUMENTS

| | | | |
|---|---|---|---|
| CN | 107819203 | A | 3/2018 |
| JP | S63-69301 | A | 3/1988 |

(Continued)

OTHER PUBLICATIONS

International Search Report issued in Application No. PCT/JP2019/012650, dated Jun. 4, 2019.

(Continued)

*Primary Examiner* — Vibol Tan

(74) *Attorney, Agent, or Firm* — Pearne & Gordon LLP

(57) ABSTRACT

An antenna module includes a dielectric substrate having a multilayer structure, an antenna element and a ground electrode that are arranged at the dielectric substrate, and a matching circuit that is formed in a region between the antenna element and the ground electrode. A radio frequency signal is supplied via the matching circuit to the antenna element.

18 Claims, 12 Drawing Sheets

(56) References Cited

U.S. PATENT DOCUMENTS

| | | | |
|---|---|---|---|
| 2009/0262041 | A1 | 10/2009 | Ikemoto et al. |
| 2011/0279190 | A1 | 11/2011 | Liu et al. |
| 2017/0229769 | A1 | 8/2017 | Yokoyama et al. |
| 2017/0279192 | A1 | 9/2017 | Taniguchi et al. |

FOREIGN PATENT DOCUMENTS

| | | | | |
|---|---|---|---|---|
| JP | H05-152829 | A | | 6/1993 |
| JP | 2000101377 | A | | 4/2000 |
| JP | 2000124728 | A | * | 4/2000 |
| JP | 2004320431 | A | * | 11/2004 |
| JP | 2005123909 | A | * | 5/2005 |
| JP | 2012-520652 | A | | 9/2012 |
| JP | 2014-155100 | A | | 8/2014 |
| JP | 2014179821 | A | * | 9/2014 |
| JP | 2015185550 | A | | 10/2015 |
| WO | 2009011376 | A1 | | 1/2009 |
| WO | 2015068252 | A | | 5/2015 |
| WO | 2016067969 | A1 | | 5/2016 |
| WO | 2016203842 | A1 | | 12/2016 |

OTHER PUBLICATIONS

Written Opinion issued in Application No. PCT/JP2019/012650, dated Jun. 4, 2019.
Chinese Office action for 201980022459.2 dated Dec. 23, 2020.
Japanese Office action for Application No. 2020-510837 dated Apr. 21, 2021.

* cited by examiner

FIG.18
| | CONFIGURATION A | CONFIGURATION B |
|---|---|---|
| EFFICIENCY [dB] | −0.24 | −0.19 |
| PEAK GAIN [dBi] | 6.58 | 6.71 |
FIG.19
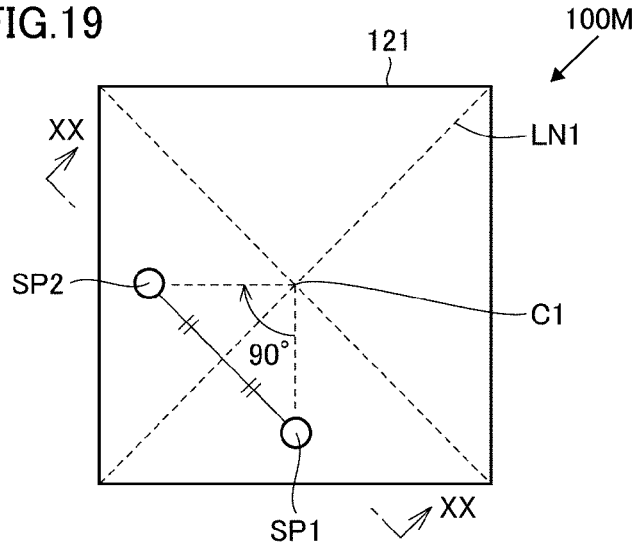
FIG.20
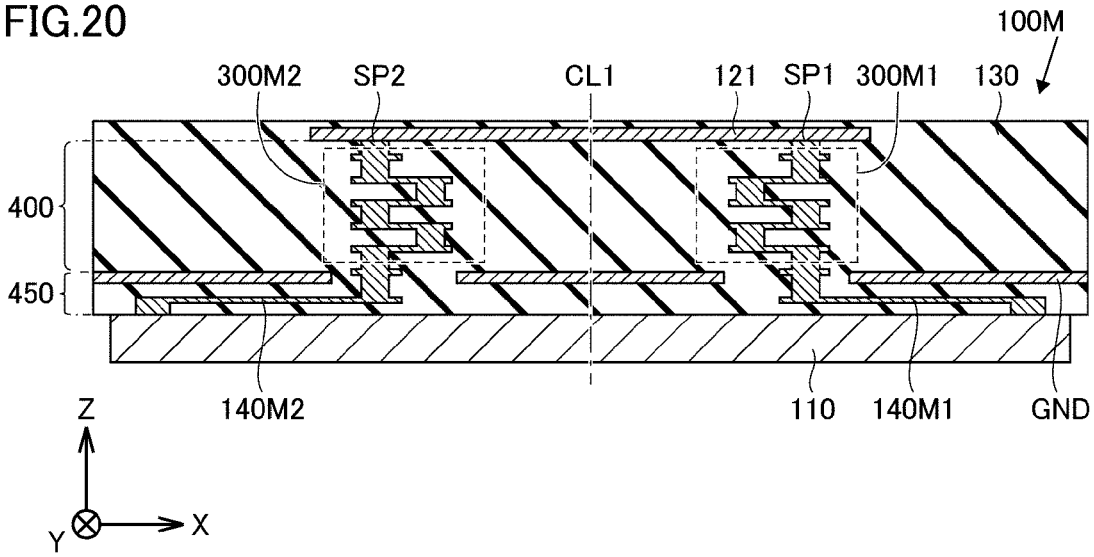

ANTENNA MODULE AND COMMUNICATION APPARATUS EQUIPPED THEREWITH

This is a continuation of International Application No. PCT/JP2019/012650 filed on Mar. 26, 2019 which claims priority from Japanese Patent Application No. 2018-070044 filed on Mar. 30, 2018. The contents of these applications are incorporated herein by reference in their entireties.

BACKGROUND

Technical Field

The present disclosure relates to an antenna module and a communication apparatus equipped therewith, and more particularly, to an antenna module including a matching circuit in an antenna region.

In WO 2016/067969 (Patent Document 1), an antenna module in which an antenna element and a radio frequency semiconductor element are mounted in an integrated manner at a dielectric substrate is disclosed. In the antenna module disclosed in Patent Document 1, a transmission line that allows a radio frequency signal to be supplied from the radio frequency semiconductor element to the antenna element extends from the radio frequency semiconductor element, passes through between a mounting surface of the dielectric substrate on which the radio frequency semiconductor element is mounted and a ground layer arranged inside the dielectric substrate, and rises to the antenna element.

Patent Document 1: WO 2016/067969

BRIEF SUMMARY

In order to ensure efficiency of an antenna of such an antenna module, impedance matching between the antenna element and the transmission line can be achieved. As a technique for such impedance matching, placing a stub on a transmission line has been known.

For impedance matching using a stub, in order to suppress signals radiated from the sub and the transmission line from affecting the antenna element, it is desirable that the stub be arranged in a layer (hereinafter, also referred to as a "transmission line layer") in which the transmission line extends, the layer being arranged lower (a side opposite the antenna element) than a ground layer (ground electrode) defining the reference potential of the antenna and between the ground electrode and the mounting surface.

Such antenna modules have also been used for portable terminals, such as smartphones. However, further reductions in size and thickness have been demanded for apparatuses, such as portable terminals. In accordance with such demands, reductions in size and thickness of antenna modules have been required.

However, in order to provide a stub, which is a matching circuit, on a transmission line to obtain a desired impedance, it is required to increase an area in which the matching circuit is to be formed in a transmission line layer. This may cause a difficulty in reducing the size of an antenna module.

The present disclosure reduced the size of an antenna module while achieving appropriate impedance matching between an antenna element and a transmission line.

An antenna module according to an aspect of the present disclosure includes a dielectric substrate having a multilayer structure, an antenna element and a ground electrode that are arranged at the dielectric substrate, and a matching circuit that is formed in a region between the antenna element and the ground electrode. A radio frequency signal is supplied via the matching circuit to the antenna element.

An antenna module according to another aspect of the present disclosure includes a dielectric substrate having a multilayer structure, an antenna element and a ground electrode that are arranged at the dielectric substrate, and a first matching circuit and a second matching circuit that are formed in a region between the antenna element and the ground electrode. A radio frequency signal is supplied via the first matching circuit to a first power feed point of the antenna element. A radio frequency signal is supplied via the second matching circuit to a second power feed point of the antenna element. The first power feed point and the second power feed point are arranged at positions that are line symmetric with respect to a diagonal passing through a center of the antenna element when the antenna element is viewed in plan from a normal direction of the antenna element.

In an antenna module according to the present disclosure, a matching circuit is formed in a region between an antenna element and a ground electrode at a dielectric substrate. Accordingly, there is no need to provide a stub in a transmission line layer. Thus, an area in which a stub is to be formed in the transmission line layer can be reduced. Therefore, a reduction in size of the antenna module can be achieved while appropriate impedance matching between the antenna element and the transmission line being achieved.

BRIEF DESCRIPTION OF THE SEVERAL VIEWS OF THE DRAWINGS

FIG. 18 is a diagram illustrating results of simulation of a transmission efficiency and a peak gain for the antenna module in FIG. 2 and the antenna module in FIG. 17.

FIG. 19 is a diagram for explaining arrangement of power feed points in an antenna module according to a second embodiment.

FIG. 20 is a cross-section view of the antenna module according to the second embodiment.

DETAILED DESCRIPTION

Figure 1:
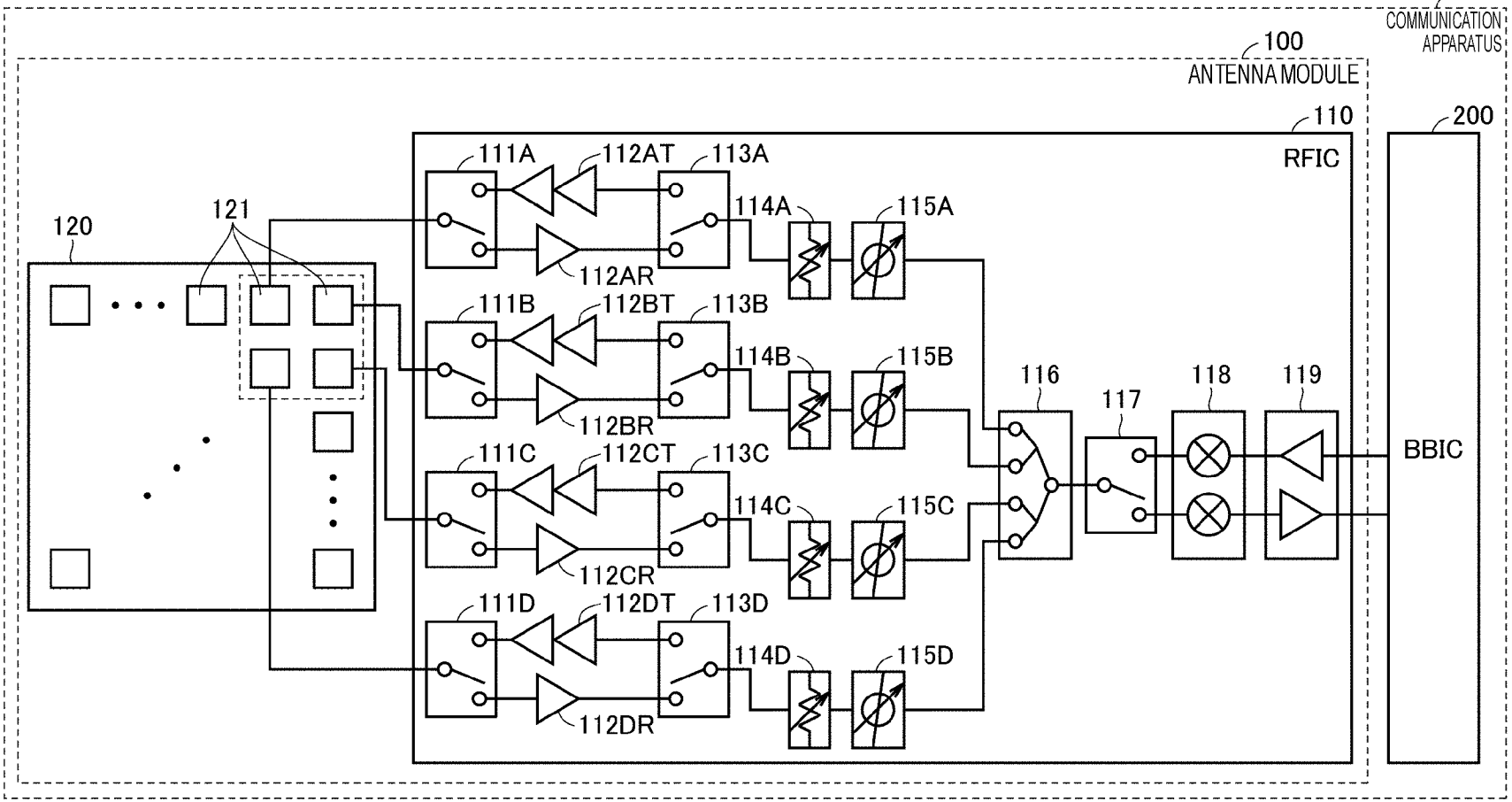
FIG. 1 is a block diagram of a communication apparatus in which an antenna module according to a first embodiment is used.

Hereinafter, embodiments of the present disclosure will be described in detail with reference to drawings. In the drawings, the same or equivalent parts will be referred to with the same signs, and explanation for those same or equivalent parts will not be repeated.

First Embodiment (Basic Configuration of Communication Apparatus)

FIG. 1 is a block diagram illustrating an example of a communication apparatus 10 in which an antenna module 100 according to a first embodiment is used. The communication apparatus 10 is, for example, a portable terminal, such as a mobile phone, a smartphone, or a tablet, a personal computer with a communication function, or the like.

Referring to FIG. 1, the communication apparatus 10 includes the antenna module 100 and a BBIC 200 configuring a baseband signal processing circuit. The antenna module 100 includes an RFIC 110, which is an example of a power-feeding circuit, and an antenna array 120. The communication apparatus 10 up-converts a signal transmitted from the BBIC 200 to the antenna module 100 into a radio frequency signal, and radiates the up-converted signal through the antenna array 120. The communication apparatus 10 also down-converts a radio frequency signal received at the antenna array 120 and processes the down-converted signal at the BBIC 200.

In FIG. 1, for easier explanation, configurations of only four antenna elements 121, out of a plurality of antenna elements 121 forming the antenna array 120, are illustrated. Illustration of other antenna elements 121 having similar configurations is omitted in FIG. 1. Furthermore, in this embodiment, a case where the antenna elements 121 are patch antennas with a rectangular flat plate shape will be described as an example.

The RFIC 110 includes switches 111A to 111D, 113A to 113D, and 117, power amplifiers 112AT to 112DT, low noise amplifiers 112AR to 112DR, attenuators 114A to 114D, phase shifters 115A to 115D, a signal multiplexer/demultiplexer 116, a mixer 118, and an amplifying circuit 119.

To transmit a radio frequency signal, the switches 111A to 111D and 113A to 113D are switched to the power amplifiers 112AT to 112DT side, and the switch 117 is connected to a transmission-side amplifier of the amplifying circuit 119. To receive a radio frequency signal, the switches 111A to 111D and 113A to 113D are switched to the low noise amplifiers 112AR to 112DR side, and the switch 117 is connected to a reception-side amplifier of the amplifying circuit 119.

A signal transmitted from the BBIC 200 is amplified at the amplifying circuit 119 and then up-converted at the mixer 118. The transmission signal, which is the up-converted radio frequency signal, is demultiplexed into four signals by the signal multiplexer/demultiplexer 116. The four signals pass through four signal paths and are supplied to corresponding antenna elements 121. At this time, the degrees of phase shifts of the phase shifters 115A to 115D that are arranged on the corresponding signal paths are adjusted individually, and the directivity of the antenna array 120 can thus be adjusted.

Reception signals, which are radio frequency signals received at the individual antenna elements 121, pass through corresponding signal paths, and are multiplexed by the signal multiplexer/demultiplexer 116. The multiplexed reception signal is down-converted at the mixer 118, amplified at the amplifying circuit 119, and then transmitted to the BBIC 200.

The RFIC 110 is formed as, for example, a single-chip integrated circuit component including the circuit configuration mentioned above. Alternatively, devices in the RFIC 110 (switches, power amplifiers, low noise amplifiers, attenuators, and phase shifters) corresponding to each of the antenna elements 121 may be formed as single-chip integrated circuit component for the antenna element 121.

(Structure of Antenna Module)

Figure 2:
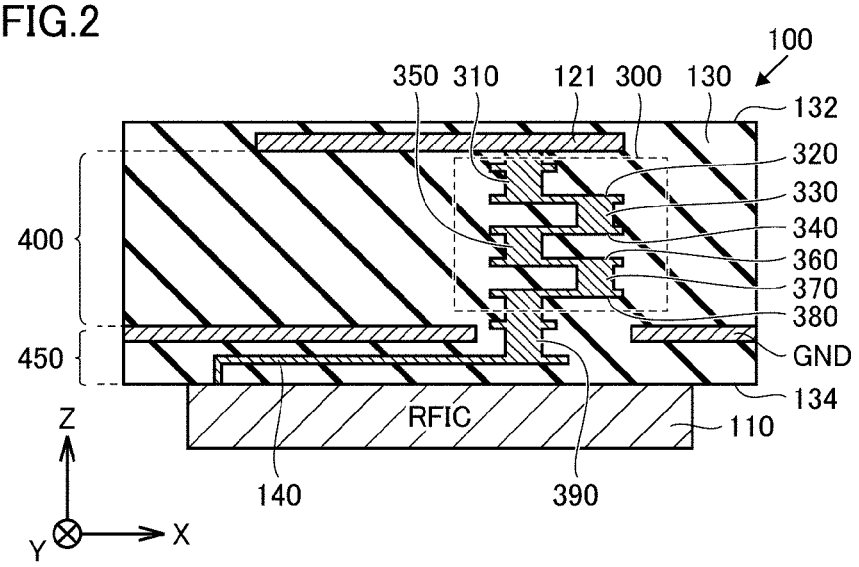
FIG. 2 is a cross-section view of the antenna module according to the first embedment.

FIG. 2 is a cross-section view of the antenna module 100 according to the first embodiment. Referring to FIG. 2, the antenna module 100 includes a dielectric substrate 130, a transmission line 140, a matching circuit 300, and a ground electrode GND, in addition to the antenna elements 121 and the RFIC 110. In FIG. 2, for easier explanation, a case where only one antenna element 121 is arranged is illustrated. However, a plurality of antenna elements 121 may be arranged.

The dielectric substrate 130 is a substrate that has a multilayer structure made of, for example, resins, such as epoxy, polyimide, or the like. Furthermore, the dielectric substrate 130 may be formed of a liquid crystal polymer (LCP) or fluorine-based resin with a lower dielectric constant.

The antenna element 121 is arranged in a first surface 132 of the dielectric substrate 130 or in a layer inside the dielectric substrate 130. The RFIC 110 is mounted on a second surface (mounting surface) 134 that is opposite the first surface 132 of the dielectric substrate 130 with a connecting electrode (not illustrated in the drawing), such as a solder bump interposed therebetween. The ground electrode GND is arranged in a part of the dielectric substrate 130 that is between the layer in which the antenna element 121 is arranged and the second surface 134.

The transmission line 140 is a wiring pattern formed in a layer between the ground electrode GND and the mounting surface 134 on which the RFIC 110 is mounted. The transmission line 140 allows a radio frequency signal from the RFIC 110 to be supplied via the matching circuit 300 to the antenna element 121.

The matching circuit 300 is arranged in a region (antenna region 400) between the antenna element 121 and the ground electrode GND. The matching circuit 300 is a circuit for matching impedance between the antenna element 121, and the RFIC 110 and the transmission line 140. The matching circuit 300 is formed of a combination of a plurality of wiring patterns 320, 340, 360, and 380 formed in layers of the dielectric substrate 130 and a plurality of via conductors (hereinafter, also simply referred to as "vias") 310, 330, 350, 370, and 390 penetrating through the layers. In the example of FIG. 2, an aspect in which vias in two layers are offset in a path extending from the transmission line 140 to the antenna element 121 is illustrated.

The vias 310, 350, and 390 are formed to overlap with each other when the antenna module 100 is viewed in plan from the normal direction. The vias 330 and 370 are formed at positions offset from the vias 310, 350, and 390. The vias 310 and 330 that are connected to the antenna element 121 are connected by the wiring pattern 320, and the vias 330 and 350 are connected by the wiring pattern 340. Furthermore, the vias 350 and 370 are connected by the wiring pattern 360, and the vias 370 and 390 are connected by the wiring pattern 380. The via 390 penetrates through the ground electrode GND and is connected to the transmission line 140.

The transmission line 140 is not necessarily provided. The via 390 may be directly connected to the RFIC 110, and a transmission line layer 450 may not be provided.

Furthermore, it is desirable that the matching circuit 300 be arranged to overlap (inwardly) with the antenna element 121 when the antenna module 100 is viewed in plan from the normal direction. A region with a strong electric field is generated from an end portion of the antenna element 121 toward the ground electrode GND. Thus, by arranging the matching circuit 300 inward with respect to the antenna element 121, the matching circuit 300 is suppressed from entering the region with the strong electric field. Accordingly, a degradation of antenna characteristics can be reduced.

Figure 3C:
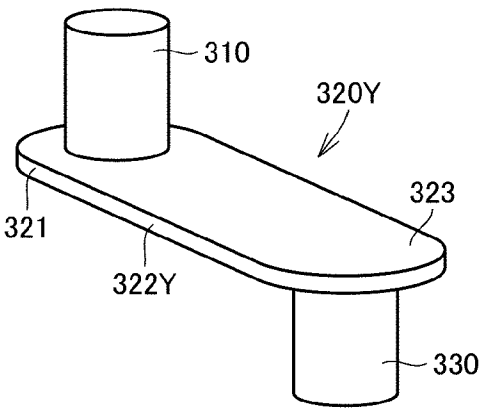
FIGS. 3A, 3B, and 3C include diagrams for explaining techniques for adjusting inductance of wiring patterns.
Figure 3B:
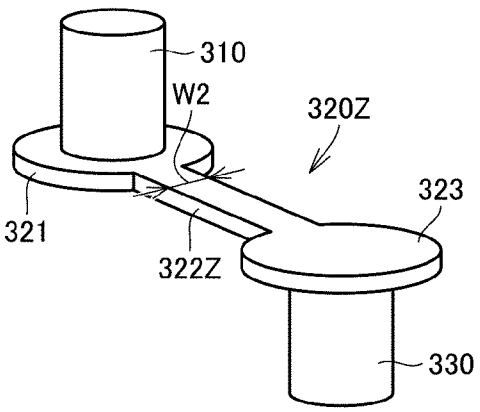
Figure 3A:
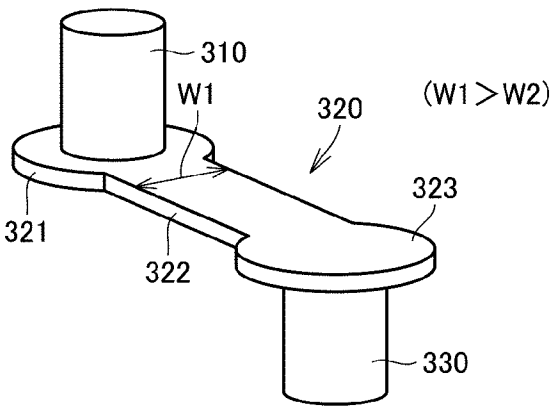

Impedance adjustment in the matching circuit 300 can be performed by changing the dimensions of wiring patterns for connecting vias. FIGS. 3A, 3B, and 3C include diagrams for explaining techniques for adjusting inductance of wiring patterns. In FIGS. 3A, 3B, and 3C, for example, the wiring pattern 320 that connects the via 310 with the via 330 will be explained.

Referring to FIG. 3A, the wiring pattern 320 includes a pad 321 connected to the via 310, a pad 323 connected to the via 330, and connection wiring 322 that connects the two pads. The inductance of the wiring pattern 320 may be adjusted by changing the length of the connection wiring 322 (that is, offset distance of the via 330) and/or the width of the connection wiring 322.

A wiring pattern 320Z in FIG. 3B is an example in which the width W2 of connection wiring 322Z is narrower than the width W1 of the connection wiring 322 in the wiring pattern 320 (W1>W2). As the width of connection wiring decreases, an inductance component of a wiring pattern increases. That is, in the matching circuit 300, connection wiring with a reduced width functions as a series inductor, which is an inductor provided in series on a main path in which a radio frequency signal is supplied from the RFIC 110 to the antenna element 121. By providing connection wiring as a meander line, inductance can further be increased.

A wiring pattern not only functions as an inductor as described above but also functions as a capacitor that is formed between the wiring pattern and the ground electrode GND. In particular, a capacitance component increases as the connection wiring approaches the ground electrode GND or as the width of the connection wiring increases. That is, when the line width of connection wiring decreases, the capacitance component of the wiring pattern decreases, and the inductance component increases. When the line width of the connection wiring increases, the capacitance component of the wiring pattern increases, and the inductance component decreases. Accordingly, the impedance of the matching circuit 300 can be adjusted by adjusting the line width of connection wiring.

More specifically, as illustrated in FIG. 3B, by making the line width of the connection wiring to be smaller than the via diameter of at least one of the via 310 and the via 330, the inductance component of the matching circuit 300 is adjusted. Furthermore, as illustrated in FIG. 3A, by making the line width of the connection wiring to be greater than the via diameter of the via 310 and the via 330, the capacitance component of the matching circuit 300 can be adjusted.

As illustrated in FIG. 3C, in a wiring pattern 320Y, the diameter (width) of each of the pads 321 and 323 may be equal to the line width of connection wiring 322Y. In this case, variations in manufacturing can be reduced. Therefore, impedance matching can be easily achieved.

Figure 4:
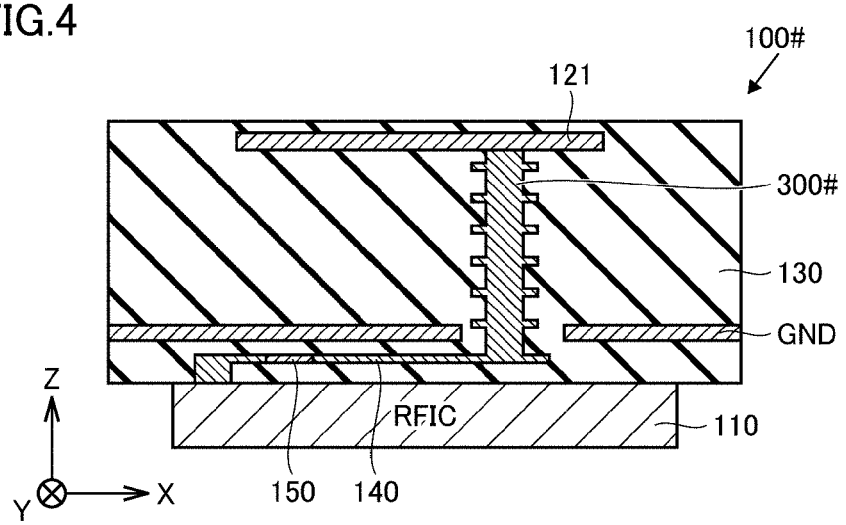
FIG. 4 is a cross-section view of an antenna module according to a comparative example.
Figure 5:
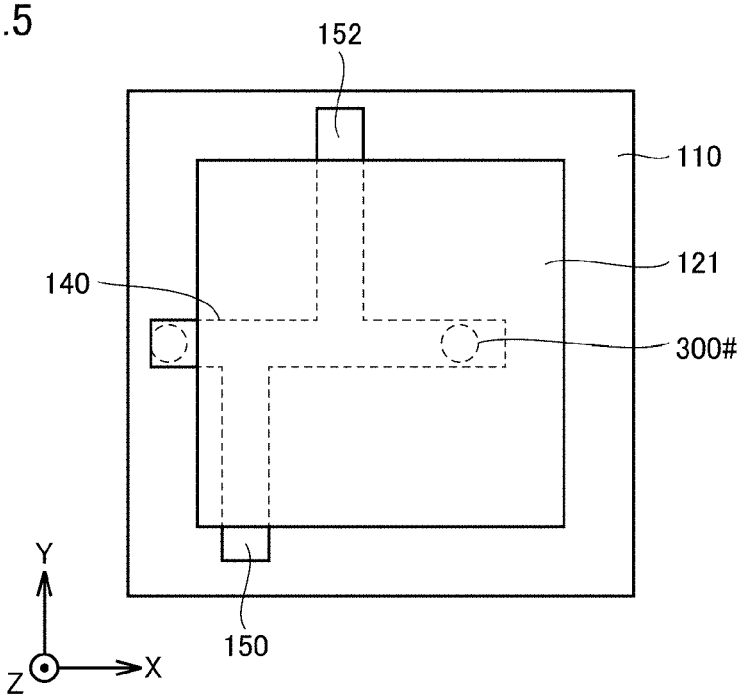
FIG. 5 is a plan view of the antenna module according to the comparative example.

FIG. 4 is a cross-section view of an antenna module 100# according to a comparative example. FIG. 5 is a plan view of the antenna module 100# according to the comparative example. In FIG. 5, for easier explanation, illustration of the ground electrode GND and the dielectric substrate 130 is not provided.

In the antenna module 100#, the region corresponding to the matching circuit 300 illustrated in FIG. 2 is formed of a single via 300# that extends from the antenna element 121 to the transmission line 140. Furthermore, in the transmission line 140, stubs 150 and 152 for adjusting the impedance of a signal path extending from the RFIC 110 to the antenna element 121 are provided.

Such an antenna module is used for portable communication terminals, such as smartphones. Further reductions in size and thickness have been demanded for apparatuses, such as portable communication terminals. In accordance with such demands, reductions in size and thickness of antenna modules have been required.

However, a new problem may arise with a configuration in which impedance matching is performed using the stubs 150 and 152, as in the comparative example in FIG. 4. That is, in order to obtain a desired impedance, it is required to increase an area in which the stubs 150 and 152 are to be formed. This may cause a difficulty in reducing the size of the antenna module.

In the antenna module 100 according to the first embodiment illustrated in FIG. 2, as described above, the matching circuit 300 is arranged in the antenna region 400 that is required to ensure antenna performance, so that impedance matching can be achieved. Thus, compared to the comparative example in which the stubs 150 and 152 are formed in the transmission line layer 450, a desired impedance can be obtained with a smaller area. Therefore, a reduction in size of the antenna module can be achieved while appropriate impedance matching between the antenna element 121 and the transmission line 140 being achieved.

For the antenna module 100 according to the first embodiment illustrated in FIG. 2, the case where a power feed element to which a radio frequency signal is supplied from the RFIC 110 is used as an antenna element is described. However, a non-power feed element may further be arranged between the power feed element and the ground electrode GND.

The configuration of the matching circuit formed in the antenna region 400 is not limited to the case illustrated in FIG. 2. The matching circuit may have other configurations. Other possibilities of configuration of a matching circuit will be described below with reference to FIGS. 6 to 17.

(First Modification)

Figure 6:
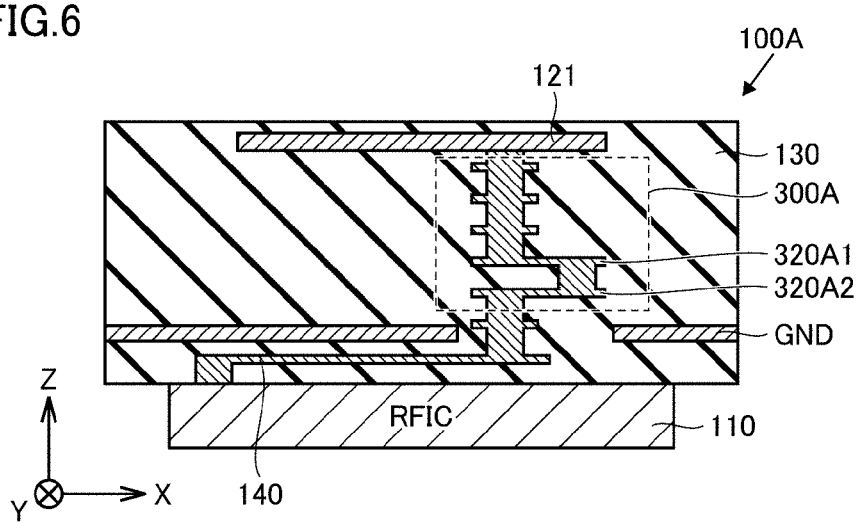
FIG. 6 is a cross-section view of an antenna module according to a first modification.

FIG. 6 is a cross-section view of an antenna module 100A according to a first modification. A matching circuit 300A included in the antenna module 100A has a configuration in which a via is offset by wiring patterns, as with the matching circuit 300 in the antenna module 100 in FIG. 2. In the matching circuit 300 in FIG. 2, vias in two layers are offset. However, in the matching circuit 300A, a via in a single layer is offset by wiring patterns 320A1 and 320A2.

That is, by adjusting the number of vias to be offset and the line width of wiring patterns, an inductance component can be increased, and impedance can thus be adjusted.

(Second Modification)

Figure 7:
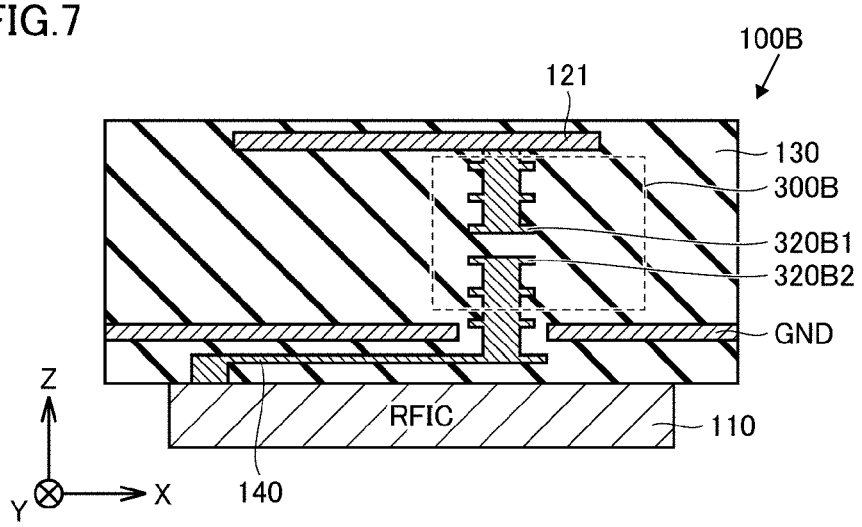
FIG. 7 is a cross-section view of an antenna module according to a second modification.

FIG. 7 is a cross-section view of an antenna module 100B according to a second modification. In a matching circuit 300B included in the antenna module 100B, a pad 320B1 is provided at an end portion of a via connected to the antenna element 121, a pad 320B2 is provided at an end portion of a via connected to the transmission line 140, and the pads 320B1 and 320B2 face each other with a dielectric interposed therebetween. The pads 320B1 and 320B2 function as a series capacitor, which is a capacitor provided in series on a main path in the matching circuit 300B.

As described above, in a layer of the dielectric substrate 130, two pads (a pair of electrodes) face each other to form a series capacitor. Thus, impedance can be adjusted.

In FIG. 7, an example in which a capacitor is formed in a single layer is illustrated. However, capacitors may be formed over a plurality of layers. Furthermore, areas of pads to form a capacitor may be adjusted so that the capacitance of the capacitor can be adjusted.

(Third Modification)

Figure 8:
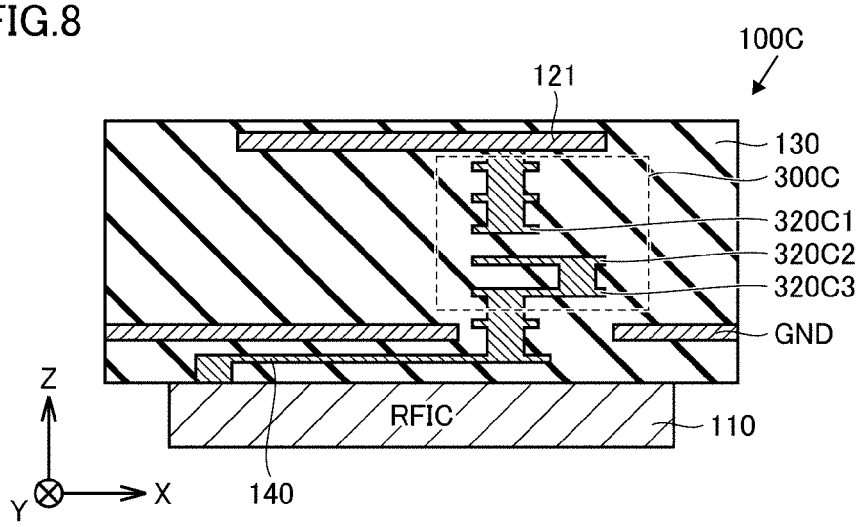
FIG. 8 is a cross-section view of an antenna module according to a third modification.

FIG. 8 is a cross-section view of an antenna module 100C according to a third modification. A matching circuit 300C included in the antenna module 100C has a configuration that is a combination of the first modification and the second modification described above. In the matching circuit 300C, a via is offset by wiring patterns 320C2 and 320C3, and a pad 320C1 and the wiring pattern 320C2 form a capacitor. That is, the matching circuit 300C is an LC matching circuit including an inductor and a capacitor.

As described above, by causing the matching circuit to have both an inductance component and a capacitance component, impedance can be adjusted easily.

(Fourth Modification)

Figure 9:
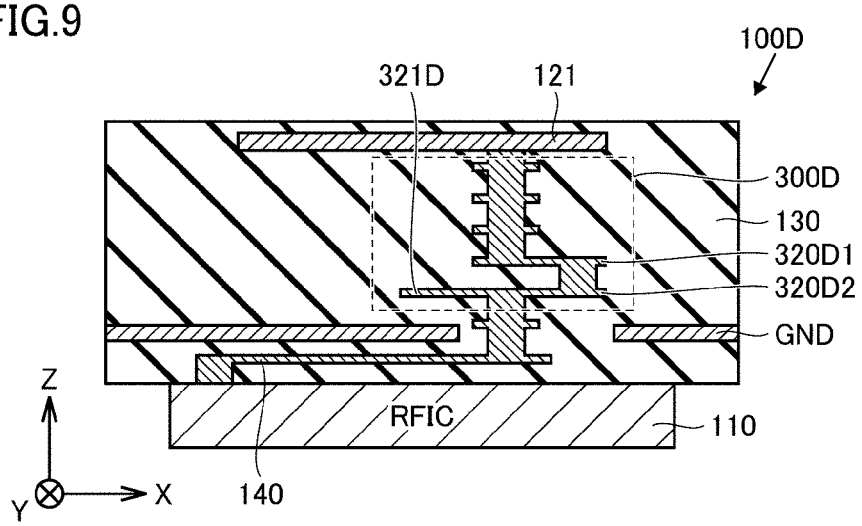
FIG. 9 is a cross-section view of a first example of an antenna module according to a fourth modification.
Figure 10:
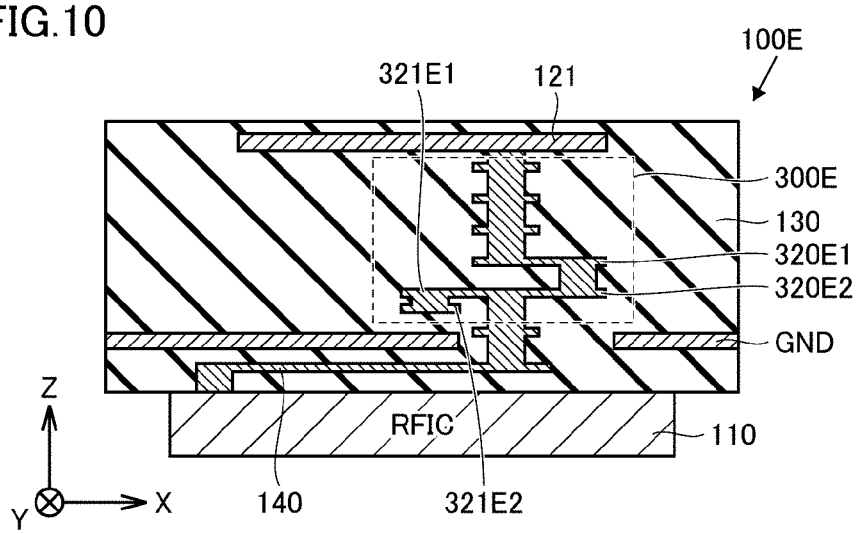
FIG. 10 is a cross-section view of a second example of the antenna module according to the fourth modification.

FIG. 9 is a cross-section view of an antenna module 100D according to a fourth modification. A matching circuit 300D included in the antenna module 100D has a configuration in which part of wiring patterns faces the ground electrode GND so that a shunt capacitor, which is a capacitor that connects the main path with the ground electrode GND, is formed in the matching circuit 300D.

Referring to FIG. 9, in the matching circuit 300D, as in the first modification in FIG. 6, a via in a single layer is offset by wiring patterns 320D1 and 320D2. A pad (electrode) 321D is further provided at an end portion of the wiring pattern 320D2, and the pad 321D faces the ground electrode GND.

By forming the shunt capacitor in the matching circuit, impedance can be adjusted.

Figure 11:
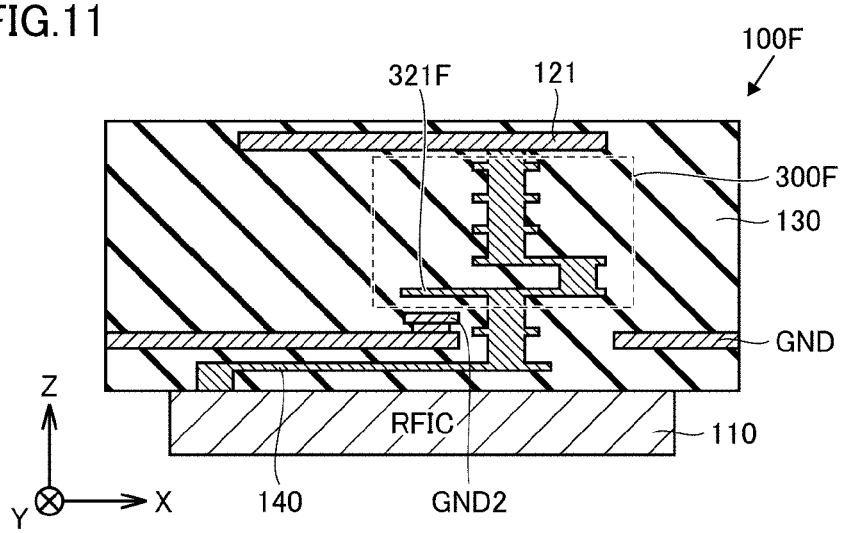
FIG. 11 is a cross-section view of a third example of the antenna module according to the fourth modification.

A capacitance value of the shunt capacitor may be adjusted by changing the distance between the pad and the ground electrode GND. For example, in a matching circuit 300E in an antenna module 100E illustrated in FIG. 10, a pad 321E1 is provided at an end portion of wiring pattern 320E2, and a pad 321E2 is further provided such that a via is arranged between the pad 321E2 and the pad 321E1. Thus, the distance to the ground electrode GND is reduced. In contrast, as illustrated in FIG. 11, in an antenna module 100F, a pad GND2 may be formed at a via rising from the ground electrode GND so that the distance to a pad 321F in a matching circuit 300F can be reduced.

(Fifth Modification)

Figure 12:
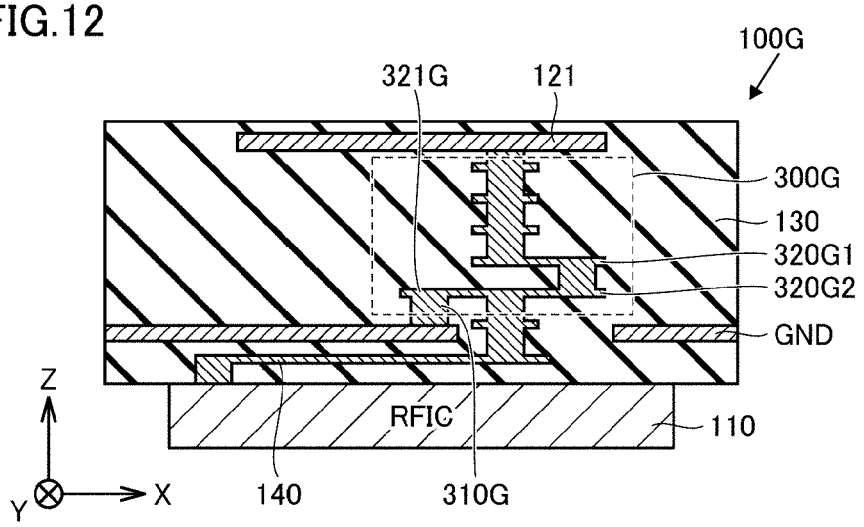
FIG. 12 is a cross-section view of an antenna module according to a fifth modification.

FIG. 12 is a cross-section view of an antenna module 100G according to a fifth modification. A matching circuit 300G included in the antenna module 100G has a configuration in which part of elements configuring the matching circuit 300G is connected to the ground electrode GND. The part connected to the ground electrode GND functions as a shunt inductor, which is an inductor that connects a main path with the ground electrode GND, in the matching circuit 300G.

In the example in FIG. 12, a pad 321G formed at an end portion of a wiring pattern 320G2 is connected to the ground electrode GND by a via 310G.

By forming the shunt inductor in the matching circuit, impedance can be adjusted. Furthermore, by providing the inductor that connects the antenna element with the ground electrode GND, current generated when electrostatic discharge from the antenna element occurs can be led to the ground electrode GND. Thus, an electronic device, such as the RFIC 110 can be protected from electrostatic discharge (ESD).

(Sixth Modification)

Figure 13:
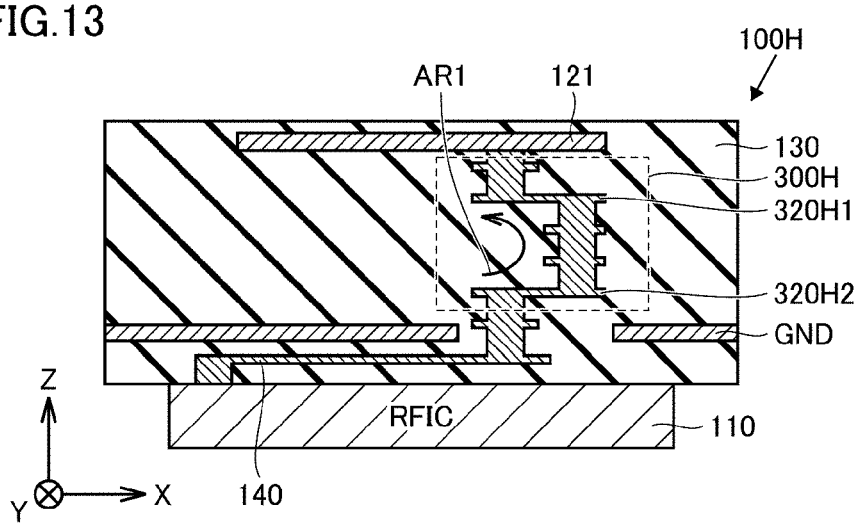
FIG. 13 is a cross-section view of an antenna module according to a sixth modification.

FIG. 13 is a cross-section view of an antenna module 100H according to a sixth modification. A matching circuit 300H included in the antenna module 100H has a configuration in which vias in a plurality of continuous layers are offset by wiring patterns 320H1 and 320H2. That is, a coil with a winding axis extending in a direction (Y-axis direction in FIG. 13) that is orthogonal to the normal direction of the antenna module 100H is formed by the wiring patterns 320H1 and 320H2 and vias connecting the wiring patterns 320H1 and 320H2.

For example, when current flows in a direction represented by arrow AR1 in FIG. 13 in the matching circuit 300H, a magnetic field extending toward a negative direction of the Y-axis is generated. Thus, in addition to an inductance component formed by the path length of the wiring patterns 320H1 and 320H2, an inductance component generated by the formed coil can further be obtained. Therefore, the adjusting width of impedance can further be increased.

Also in the configuration, as illustrated in FIG. 6 and the like, in which a via in a single layer is offset, wiring patterns and the offset via form a coil substantially similar to that in FIG. 13.

(Seventh Modification)

Figure 14:
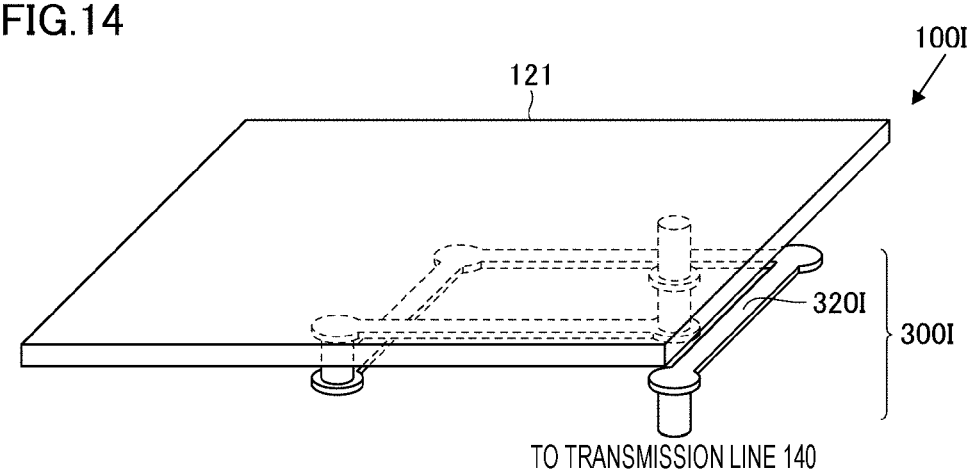
FIG. 14 is a perspective view illustrating an antenna element and part of a matching circuit in an antenna module according to a seventh modification.

FIG. 14 is a perspective view illustrating the antenna element 121 and part of a matching circuit 300I in an antenna module 100I according to a seventh modification. In the matching circuit 300I, a wiring pattern 320I formed in a layer of the dielectric substrate 130 is formed in a coil shape with a winding axis extending in the normal direction of the antenna module 100I. With this configuration, as in the sixth modification, impedance adjustment can be performed using an inductance component generated by the formed coil.

(Eighth Modification)

Figure 15:
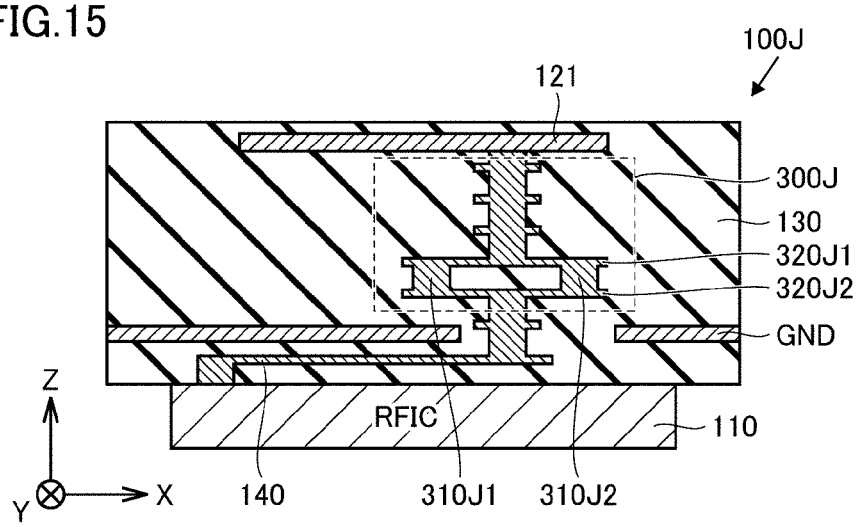
FIG. 15 is a cross-section view of an antenna module according to an eighth modification.

FIG. 15 is a cross-section view of an antenna module 100J according to an eighth modification. A matching circuit 300J included in the antenna module 100J has a configuration in which upper and lower layers are connected by a plurality of vias. In FIG. 15, a wiring pattern 320J1 and a wiring pattern 320J2 are connected by two vias 310J1 and 310J2 arranged in parallel.

As described above, upper and lower layers are connected by vias arranged in parallel. Thus, an inductance component can be reduced compared to a case where upper and lower layers are connected by a single via.

(Ninth Modification)

Figure 16:
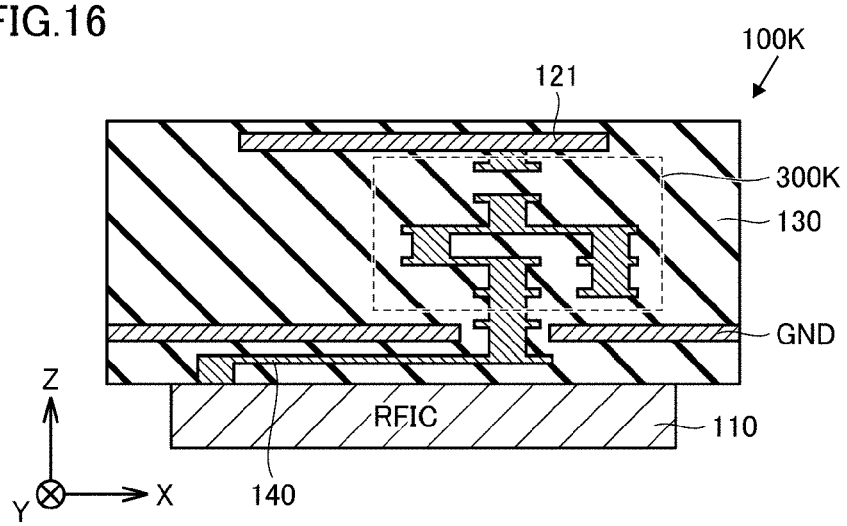
FIG. 16 is a cross-section view of an antenna module according to a ninth modification.

The configurations of the first to eighth modifications described above may be combined in an appropriate manner so that a desired impedance matching can be achieved. FIG. 16 is a cross-section view of an antenna module 100K according to a ninth modification in which some of the configurations described above are combined. In a matching circuit 300K included in the antenna module 100K, the offset via illustrated in the first modification and the like, the series capacitor illustrated in the second modification, and the shunt capacitor illustrated in the fourth modification are formed. The combination illustrated in FIG. 16 is merely an example. Impedance matching may be performed by combining other configurations.

(Tenth Modification)

Figure 17:
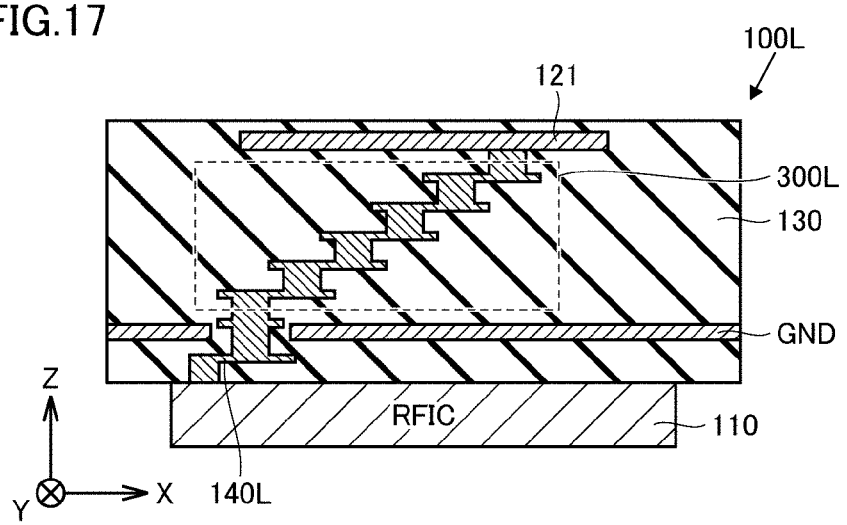
FIG. 17 is a cross-section view of an antenna module according to a tenth modification.

FIG. 17 is a cross-section view of an antenna module 100L according to a tenth modification. In a matching circuit 300L included in the antenna module 100L, vias and wiring patterns are arranged in an alternate manner such that a stepped path is formed from a transmission line 140L to a power feed point of the antenna element 121.

The transmission line is close to the ground electrode GND. Thus, when current flows in the transmission line, induced current flows to the ground electrode GND. Due to influence of an electromagnetic field generated by the induced current, the transmission efficiency of a signal passing through the transmission line decreases. Thus, in order to increase the transmission efficiency of the antenna module, it is desirable that the length of the transmission line in the transmission line layer be as short as possible.

In the tenth modification, with the matching circuit 300L formed in the stepped shape, the length of the transmission line 140L in the transmission line layer is shorter than those in the antenna modules described in the first to ninth modifications. Thus, in the tenth modification, the transmission efficiency of the antenna module can be improved.

For example, results of simulation of a transmission efficiency and a peak gain for the antenna module 100 (configuration A) illustrated in FIG. 2 and the antenna module 100L (configuration B) illustrated in FIG. 17 are illustrated in FIG. 18. As is clear from FIG. 18, a higher transmission efficiency and a higher peak gain can be attained in the tenth modification (configuration B) than the configuration A.

As described above, in the first embodiment and the modifications thereof, in place of a configuration in which a stub is provided in a transmission line layer, a configuration including a matching circuit arranged in an antenna region is provided. Thus, a reduction in size of the antenna module can be achieved while appropriate impedance matching between the antenna element and the transmission line being achieved.

Second Embodiment

In the first embodiment and the modifications thereof, an antenna module of a single polarization type in which a radio frequency signal is supplied to a single power feed point of an antenna element has been described. In a second embodiment, an antenna module of a dual polarization type in which a radio frequency signal is supplied to two power feed points of an antenna element will be described.

FIG. 19 is a diagram for explaining arrangement of power feed points in an antenna module 100M according to the second embodiment. FIG. 19 is a diagram of the antenna element 121 when viewed in plan from the normal direction of the antenna module 100M.

Referring to FIG. 19, two power feed points SP1 and SP2 are provided in the antenna element 121 included in the antenna module 100M according to the second embodiment. The antenna element 121 has a square shape. The power feed point SP1 is arranged on a bisector on one side of the antenna element 121. The power feed point SP2 is arranged such that the power feed point SP2 and the power feed point SP1 are line symmetric with respect to a diagonal LN1 of the antenna element 121.

In other words, the power feed point SP2 is located at a position obtained by rotating the power feed point SP1 by 90 degrees with respect to an intersection C1 of diagonals of the antenna element 121 (that is, the center of the antenna element 121). By arranging two power feed points at the positions mentioned above, two polarizations with a 90 degree difference in the excitation direction can be radiated from a single antenna element.

Figure 21:
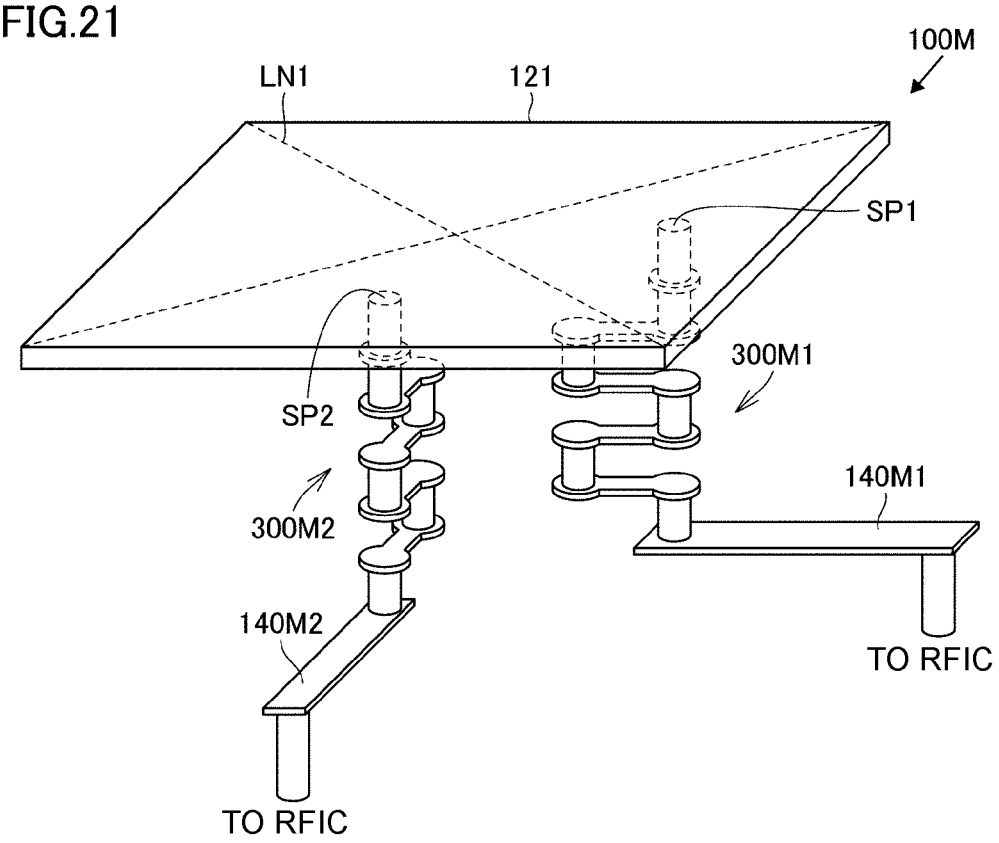
FIG. 21 is a perspective view illustrating an antenna element and part of matching circuits in the antenna module according to the second embodiment.

A cross-section of the antenna module 100M taken along line XX-XX passing through the two power feed points SP1 and SP2 is illustrated in FIG. 20. Furthermore, a perspective view illustrating an antenna element and part of matching circuits in the antenna module 100M is illustrated in FIG. 21. A radio frequency signal is supplied from the RFIC 110 through a transmission line 140M1 and a matching circuit 300M1 to the power feed point SP1. Furthermore, a radio frequency signal is supplied from the RFIC 110 through a transmission line 140M2 and a matching circuit 300M2 to the power feed point SP2.

The matching circuits 300M1 and 300M2 in FIG. 20 are formed in the antenna region 400. The matching circuits 300M1 and 300M2, each has the same configuration as that of the matching circuit 300 according to the first embodiment illustrated in FIG. 2. The matching circuits 300M1 and 300M2 are arranged to be mirror images with respect to a plane passing through a diagonal LN1 and vertical to the antenna element 121 (CL1 in FIG. 20). The matching circuits 300M1 and 300M2 may have other configurations.

In an antenna module of a dual polarization type, for impedance matching using a stub arranged in the transmission line layer 450, a large area in which a stub is to be formed is required compared to a case where an antenna module of a single polarization type is used. Thus, it may be further difficult to reduce the size of the antenna module.

As illustrated in FIGS. 19 to 21, by providing the matching circuits 300M1 and 300M2 in the antenna region 400, space saving for the entire antenna module can be achieved, and a reduction in size of the antenna module can be attained. Furthermore, by arranging a path extending from the RFIC 110 to the two power feed points SP1 and SP2 at a position forming mirror images, as illustrated in FIG. 20, symmetry of two radiated polarizations can be ensured, and isolation between two signal paths can be ensured.

The example in which an antenna element is square is described above. However, in the case where an antenna element is formed to be a round or regular polygon shape, the two power feed points SP1 and SP2 are arranged at positions that are line symmetric with respect to a diagonal passing through the center of the antenna element.

(Eleventh Modification)

Figure 22:
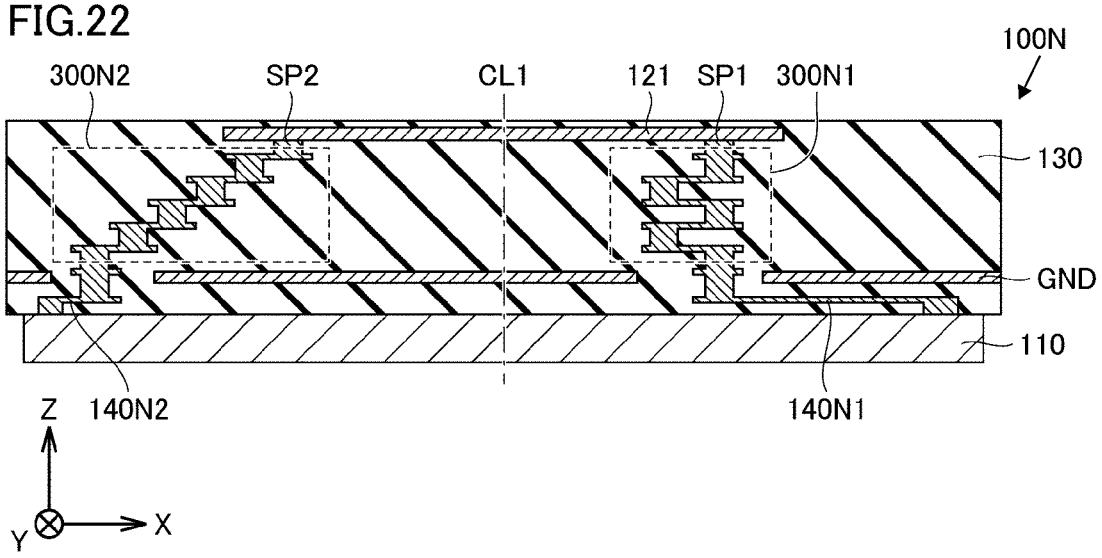
FIG. 22 is a cross-section view of an antenna module according to an eleventh modification.
Figure 23:
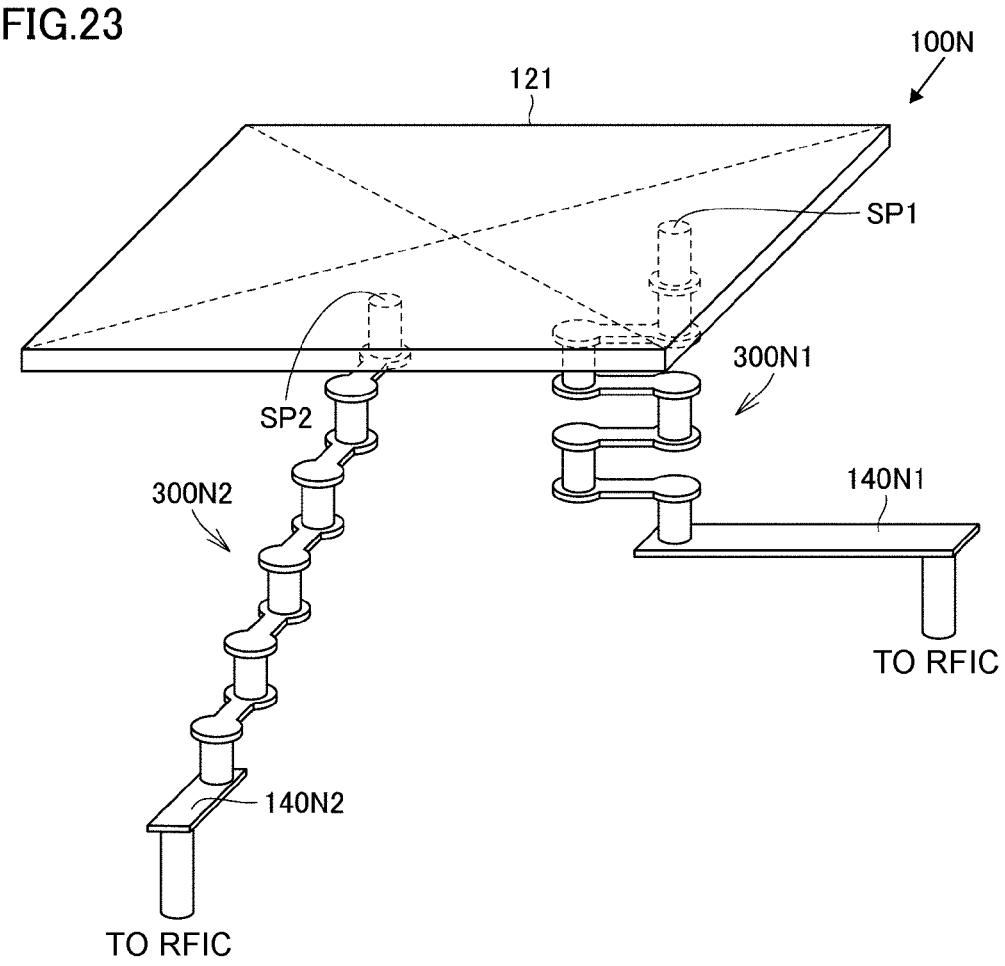
FIG. 23 is a perspective view illustrating an antenna element and part of a matching circuit in the antenna module according to the eleventh modification.

In the case where symmetry of two polarizations is not required, two matching circuits are not necessarily arranged to be mirror images. For example, as illustrated in FIGS. 22 and 23, in an antenna module 100N according to an eleventh modification, two matching circuits 300N1 and 300N2 may have different configurations. For example, in the antenna module 100N, the matching circuit 300N1 has the configuration of the matching circuit according to the first embodiment illustrated in FIG. 2 and the matching circuit 300N2 has the configuration of the matching circuit according to the tenth modification illustrated in FIG. 17. The matching circuits 300N1 and 300N2 may have other configurations.

EXAMPLES OF ARRANGEMENT OF ANTENNA ARRAY

Figure 24:
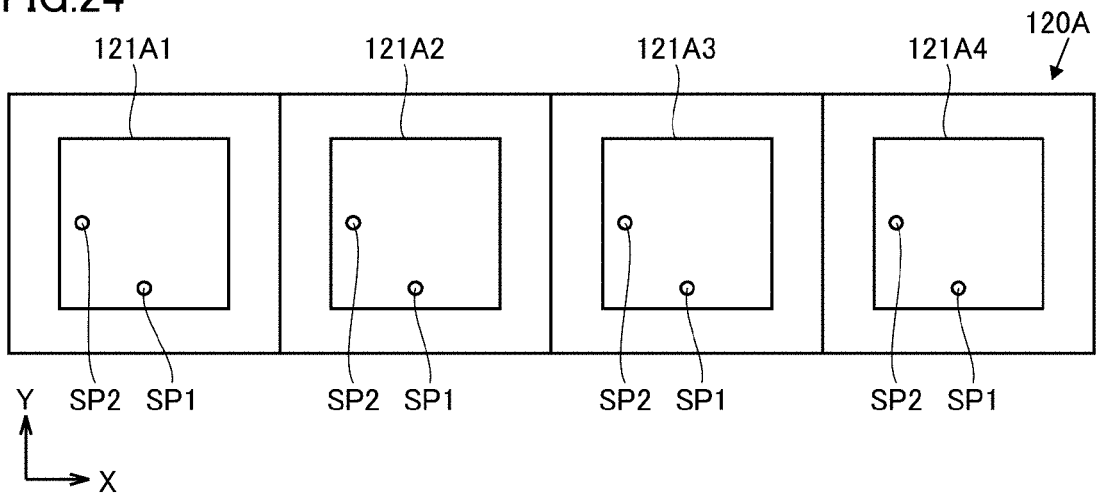
FIG. 24 is a diagram illustrating a first arrangement of an antenna array.
Figure 25:
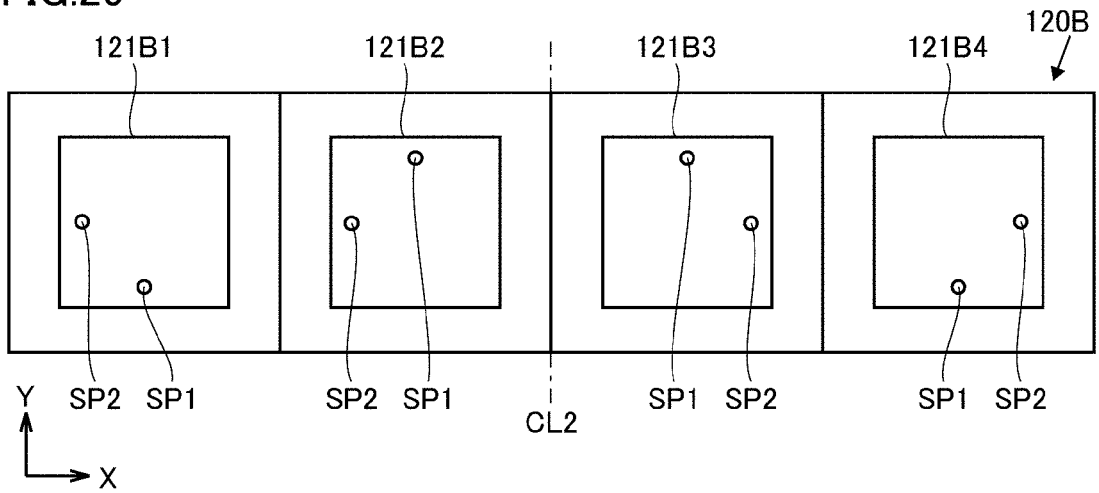
FIG. 25 is a diagram illustrating a second arrangement of the antenna array.
Figure 26:
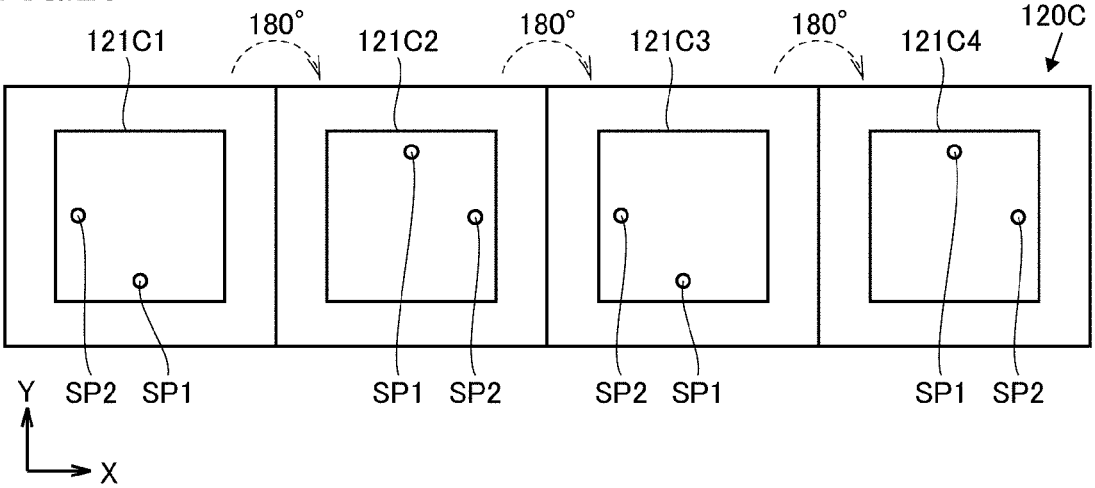
FIG. 26 is a diagram illustrating a third arrangement of the antenna array.

Examples of arrangement of an antenna array in which antenna modules of a dual polarization type are arranged will be described with reference to FIGS. 24 to 26. In FIGS. 24 to 26, for example, configurations in which four antenna modules are arranged in a line, as illustrated in FIG. 20, are illustrated.

Arrangement Example 1

In an antenna array 120A in FIG. 24, which represents arrangement example 1, antenna elements 121A1, 121A2, 121A3, and 121A4 of four antenna modules are arranged in the same direction. Specifically, in each of the antenna elements, with respect to the intersection of diagonals of the antenna element, the power feed point SP1 is offset in the negative direction of the Y axis, and the power feed point SP2 is offset in the negative direction of the X axis.

For impedance matching using a stub, an area in which the stub is to be formed is required between antenna elements. For reduction of interference in a stub caused by adjacent antenna modules, arrangement (orientation) of the antenna modules may be restricted or increasing the space between the antenna elements may be required.

As in the second embodiment, by forming an antenna array including an antenna module that achieves impedance matching using a matching circuit arranged in an antenna region, the area efficiency of the antenna array can be improved and reduction in size of the antenna array can be achieved, compared to the case where a stub is used.

The example in which an antenna module in which a single RFIC is provided for a single antenna element is used has been described above. However, an antenna module having a configuration in which radio frequency signals are supplied to a plurality of antenna elements, for example, two or four antenna elements, from a single RFIC may also be used.

Arrangement Example 2

In an antenna array 120B in arrangement example 2 illustrated in FIG. 25, an antenna element 121B1 and an antenna element 121B2 are arranged such that they are reversed relative to the X axis, and an antenna element 121B3 and an antenna element 121B4 are arranged such that they are reversed relative to the X axis. Furthermore, a pair of the antenna elements 121B1 and 121B2 and a pair of the antenna elements 121B3 and 121B4 are arranged such that these pairs are line symmetric with respect to a center line CL2.

More particularly, in the antenna element 121B1, the power feed point SP1 is offset in the negative direction of the Y axis, and the power feed point SP2 is offset in the negative direction of the X axis. In the antenna element 121B2, the power feed point SP1 is offset in the positive direction of the Y axis, and the power feed point SP2 is offset in the negative direction of X axis. Furthermore, in the antenna element 121B3, the power feed point SP1 is offset in the positive direction of the Y axis, and the power feed point SP2 is offset in the positive direction of the X axis. In the antenna element 121B4, the power feed point SP1 is offset in the negative direction of the Y axis, and the power feed point SP2 is offset in the positive direction of the X axis.

As described above, in each of the pair of the adjacent antenna elements 121B1 and 121B2 and the pair of the adjacent antenna elements 121B3 and 121B4, electronic waves radiated from the power feed point SP1 of one antenna element and electronic waves radiated from the power feed point SP1 of the other antenna element have opposite phases. Accordingly, cross polarization components in electronic waves radiated from the power feed points SP1 cancel each other out, and cross polarization discrimination (XPD) can thus be improved.

Furthermore, the pair of the antenna elements 121B1 and 121B2 and the pair of the antenna elements 121B3 and 121B4 are arranged in line symmetry with respect to the center line CL2. Thus, electronic waves radiated from the power feed points SP2 of the antenna elements 121B1 and 121B2 and electronic waves radiated from the power feed points SP2 of the antenna elements 121B3 and 121B4 have opposite phases. Accordingly, as the whole antenna array 120B, cross polarization components in electronic waves radiated from the power feed point SP2 cancel each other out, and XPD can thus be improved.

Arrangement Example 3

In an antenna array 120C in arrangement example 3 illustrated in FIG. 26, four antenna elements 121C1 to 121C4 are arranged such that adjacent antenna elements are rotated by 180 degrees.

More particularly, in each of the antenna elements 121C1 and 121C3, the power feed point SP1 is offset in the negative direction of the Y axis, and the power feed point SP2 is offset in the negative direction of the X axis. In each of the antenna elements 121C2 and 121C4, the power feed point SP1 is offset in the positive direction of the Y axis, and the power feed point SP2 is offset in the positive direction of the X axis.

That is, electronic waves radiated from the power feed points SP1 of adjacent antenna elements have opposite phases. Accordingly, cross polarization components in electronic waves radiated from the power feed points SP1 cancel each other out, and XPD can thus be improved. The same applies to electronic waves radiated from the power feed points SP2.

In an antenna array, arrangement of antenna modules for improving XPD is not limited to the modes illustrated in FIGS. 25 and 26. By arranging antenna modules such that electronic waves radiated from the power feed points SP1 and SP2 have opposite phases as the whole antenna array, XPD of the antenna array can be improved.

It should be understood that the embodiments disclosed herein are illustrative and non-restrictive in every respect.

The scope of the present disclosure is defined by the scope of the claims, rather than the description above, and is intended to include any modification within the scope and meaning equivalent to the scope of the claims.

REFERENCE SIGNS LIST

10 communication apparatus, 100 and 100A to 100N antenna module, 111A to 111D, 113A to 113D, and 117 switch, 112AR to 112DR low noise amplifier, 112AT to 112DT power amplifier, 114A to 114D attenuator, 115A to 115D phase shifter, 116 signal multiplexer/demultiplexer, 118 mixer, 119 amplifying circuit, 120 and 120A to 120C antenna array, 121, 121A1 to 121A4, 121B1 to 121B4, and 121C1 to 121C4 antenna element, 130 dielectric substrate, 132 first surface, 134 second surface, 140, 140L, 140M1, 140M2, 140N1, and 140N2 transmission line, 150 and 152 stub, 240, 260, 280, 320, 320A1, 320A2, 320C2, 320C3, 320D1, 320D2, 320E2, 320G2, 320H2, 320H1, 320I, 320J1, 320J2, 320Y, 320Z, 340, 360, and 380 wiring pattern, 300, 300A to 300L, 300M1, 300M2, 300N1, and 300N2 matching circuit, 300#, 310, 310G, 310J1, 310J2, 330, 350, 370, and 390 via, 320B1, 320B2, 320C1, 321, 321D, 321E1, 321E2, 321F, 321G, 323, and GND2 pad, 322, 322Y, and 322Z connection wiring, 400 antenna region, 450 transmission line layer, GND ground electrode, SP1 and SP2 power feed point.

The invention claimed is:

1. An antenna module comprising:

a multilayer dielectric substrate;

an antenna in or on the multilayer dielectric substrate;

a ground electrode in or on the multilayer dielectric substrate; and a matching circuit located in a region between the antenna and the ground electrode, the matching circuit comprising:

a first via conductor and a second via conductor, and a first wiring pattern that connects the first via conductor with the second via conductor, wherein, as seen in a plan view of the antenna module along a normal direction, the first via conductor and the second via conductor are offset, and wherein the matching circuit is configured to pass a radio frequency signal to the antenna.

2. The antenna module according to claim 1, wherein the matching circuit is configured to be inductive or capacitive.

3. The antenna module according to claim 1, wherein a width of wiring of the first wiring pattern is less than a diameter of the first via conductor or is less than a diameter of the second via conductor.

4. The antenna module according to claim 1, wherein a width of wiring of the first wiring pattern is greater than a diameter of the first via conductor and is greater than a diameter of the second via conductor.

5. The antenna module according to claim 1, wherein a coil comprising the first via conductor, the second via conductor, and the first wiring pattern has a winding axis that extends in a normal direction of the antenna module.

6. The antenna module according to claim 1, wherein the matching circuit comprises:

a second wiring pattern, wherein:

the first wiring pattern connects a first end of the first via conductor with a first end of the second via conductor, and the second wiring pattern connects a second end of the first via conductor with a second end of the second via conductor.

7. The antenna module according to claim 1, wherein the matching circuit comprises a first electrode that faces the ground electrode and that is capacitively coupled to the ground electrode.

8. The antenna module according to claim 1, further comprising:

a first electrode that is in a layer of the multilayer dielectric substrate between the ground electrode and the antenna, and that is connected to the ground electrode, wherein the matching circuit comprises a second electrode that faces the first electrode, and that is capacitively coupled to the first electrode.

9. The antenna module according to claim 1, wherein the matching circuit comprises an electrode that is connected to the ground electrode.

10. The antenna module according to claim 1, further comprising:

a power-feeding circuit that is mounted on a mounting surface of the multilayer dielectric substrate, and that is configured to supply the radio frequency signal to the antenna.

11. The antenna module according to claim 1, further comprising:

a power-feeding circuit that is mounted on a mounting surface of the multilayer dielectric substrate, and that is configured to supply the radio frequency signal to the antenna; and a transmission line that is in a layer of the multilayer dielectric substrate between the ground electrode and the mounting surface, and that is configured to transmit the radio frequency signal from the power-feeding circuit to the matching circuit, wherein the matching circuit comprises a plurality of via conductors including the first via conductor and the second via conductor, and a plurality of wiring patterns including the first wiring pattern, that connect the transmission line to the antenna, and wherein the plurality of via conductors and the plurality of wiring patterns are arranged so as to form a stepped path extending from the transmission line to the antenna.

12. A communication apparatus comprising the antenna module according to claim 1.

13. An antenna module comprising:

a multilayer dielectric substrate;

an antenna in or on the multilayer dielectric substrate;

a ground electrode in or on the multilayer dielectric substrate; and a matching circuit located in a region between the antenna and the ground electrode, wherein the matching circuit comprises:

a first via conductor, a second via conductor, and a third via conductor, a first wiring pattern that connects an upper end of the first via conductor with a lower end of the second via conductor, and a second wiring pattern that connects an upper end of the second via conductor and a lower end of the third via conductor, wherein the matching circuit is configured to pass a radio frequency signal to the antenna, and wherein a coil comprising the first, second, and third via conductors and the first and second wiring patterns has a winding axis that extends in a direction orthogonal to a normal direction of the antenna module.

14. An antenna module comprising:

a multilayer dielectric substrate;

an antenna in or on the multilayer dielectric substrate;

a ground electrode in or on the multilayer dielectric substrate; and a matching circuit located in a region between the antenna and the ground electrode, wherein the matching circuit comprises a pair of electrodes that face each other, the pair of electrodes functioning as a capacitor, and wherein the matching circuit is configured to pass a radio frequency signal to the antenna.

15. An antenna module comprising:

a multilayer dielectric substrate;

an antenna in or on the multilayer dielectric substrate;

a ground electrode in or on the multilayer dielectric substrate; and a first matching circuit and a second matching circuit that are located in a region between the antenna and the ground electrode, wherein the first matching circuit is configured to supply a radio frequency signal to a first power feed point of the antenna, wherein the second matching circuit is configured to supply the radio frequency signal to a second power feed point of the antenna element, and wherein, as seen in a plan view of the antenna along a normal direction, the first power feed point and the second power feed point are located symmetrically with respect to a diagonal passing through a center of the antenna.

16. The antenna module according to claim 15, wherein the first matching circuit and the second matching circuit are mirror images of each other relative to a plane that passes through the diagonal and that is perpendicular to the antenna.

17. The antenna module according to claim 15, wherein the antenna has a flat square shape, and wherein the first power feed point and the second power feed point are located symmetrically with respect to the diagonal of the antenna.

18. A communication apparatus comprising the antenna module according to claim 15.

* * * * *